US010836413B2

(12) United States Patent
Da Costa et al.

(10) Patent No.: US 10,836,413 B2
(45) Date of Patent: Nov. 17, 2020

(54) CONTROL ARRANGEMENT FOR A RAILROAD LEVEL CROSSING

(71) Applicant: Technological Resources Pty. Limited, Melbourne (AU)

(72) Inventors: Ilidio Gouveia Da Costa, Kardinya (AU); Tiberio Virgilio Nogueira Pereira, Kardinya (AU)

(73) Assignee: Technological Resources Pty. Limited, Melbourne (AU)

( * ) Notice: Subject to any disclaimer, the term of this patent is extended or adjusted under 35 U.S.C. 154(b) by 248 days.

(21) Appl. No.: 15/738,687

(22) PCT Filed: Jun. 23, 2016

(86) PCT No.: PCT/AU2016/050533
§ 371 (c)(1),
(2) Date: Dec. 21, 2017

(87) PCT Pub. No.: WO2016/205884
PCT Pub. Date: Dec. 29, 2016

(65) Prior Publication Data

US 2018/0186392 A1 Jul. 5, 2018

(30) Foreign Application Priority Data

Jun. 25, 2015 (AU) ..... 2015902470

(51) Int. Cl.
*B61L 29/00* (2006.01)
*G08G 7/02* (2006.01)
(Continued)

(52) U.S. Cl.
CPC ..... *B61L 29/00* (2013.01); *B61L 3/008* (2013.01); *B61L 23/007* (2013.01);
(Continued)

(58) Field of Classification Search
CPC ..... B61L 23/007; B61L 23/041; B61L 29/00; B61L 29/30; B61L 3/008; B61L 29/18; B61L 23/00; B61L 29/04; G08G 7/02
See application file for complete search history.

(56) References Cited

U.S. PATENT DOCUMENTS 6,933,858 B2 * 8/2005 Pieralli ..... B61L 29/30 246/292
8,935,022 B2 * 1/2015 Cooper ..... H04W 74/04 180/14.1

(Continued)

FOREIGN PATENT DOCUMENTS

EP 1849679 B1 8/2008
GB 2498564 * 7/2013
WO 2014167067 A2 10/2014

OTHER PUBLICATIONS

Aug. 7, 2016—International Search Report and Written Opinion of PCT/AU2016/050533.

(Continued)

*Primary Examiner* — Mark T Le
(74) *Attorney, Agent, or Firm* — Banner & Witcoff, Ltd.

(57) ABSTRACT

A control arrangement for a railroad level crossing is disclosed. The control arrangement comprises monitoring sensors for monitoring the level crossing, the monitoring sensors arranged to detect an obstruction within a restricted area at or near to the level crossing, and a processing unit associated with the monitoring sensors and arranged to generate an alarm warning when an obstruction is detected. The alarm warning is used to adjust a Movement Authority issued to a train approaching the level crossing.

12 Claims, 4 Drawing Sheets

(51) Int. Cl.

| | |
|---|---|
| ***B61L 23/04*** | (2006.01) |
| ***B61L 3/00*** | (2006.01) |
| ***B61L 29/30*** | (2006.01) |
| ***B61L 23/00*** | (2006.01) |

(52) U.S. Cl.
CPC ..... *B61L 23/041* (2013.01); *B61L 29/30* (2013.01); *G08G 7/02* (2013.01)

(56) References Cited

U.S. PATENT DOCUMENTS

2007/0274158 A1* 11/2007 Agam ..... B61L 23/041 367/96
2008/0195257 A1* 8/2008 Rauch ..... B61B 1/02 701/1
2011/0315852 A1* 12/2011 Borlez ..... B61L 29/02 250/206

OTHER PUBLICATIONS

Sep. 12, 2017—International Preliminary Report on Patentability of PCT/AU2016/050533.
Abir Imtiaz et al., "Automated System for Bangladesh Railway", Global Science and Technology Journal, pp. 25-40, vol. 3. No. 1. Mar. 2015 Issue., School of Engineering and Computer Science, BRAC University, Dhaka, Bangladesh.
Ian McCullough, "Irse International Technical Committee International Barriers to Level Crossing", Apr. 21, 2008.
Aug. 14, 2015—International-Type Search Report (PCT Article 15(5)) AU2015902470.

* cited by examiner

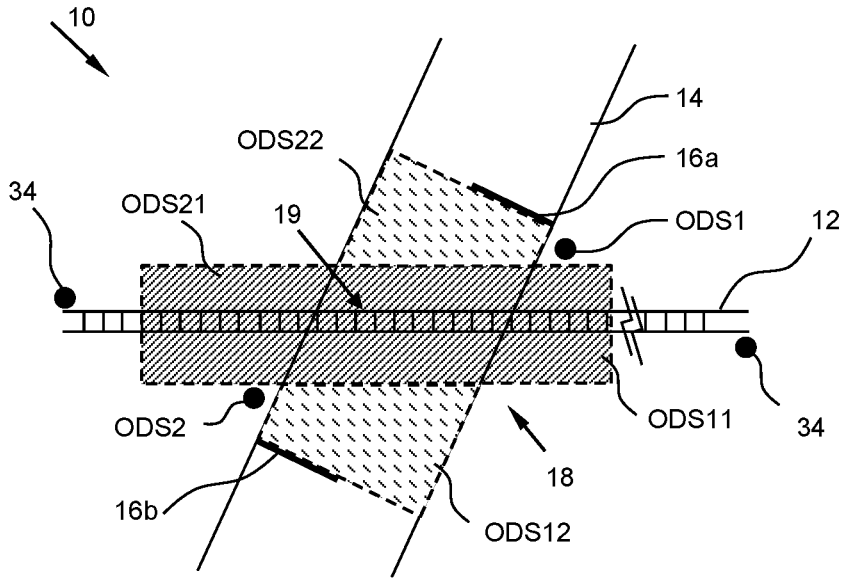
Fig. 1
Fig. 2
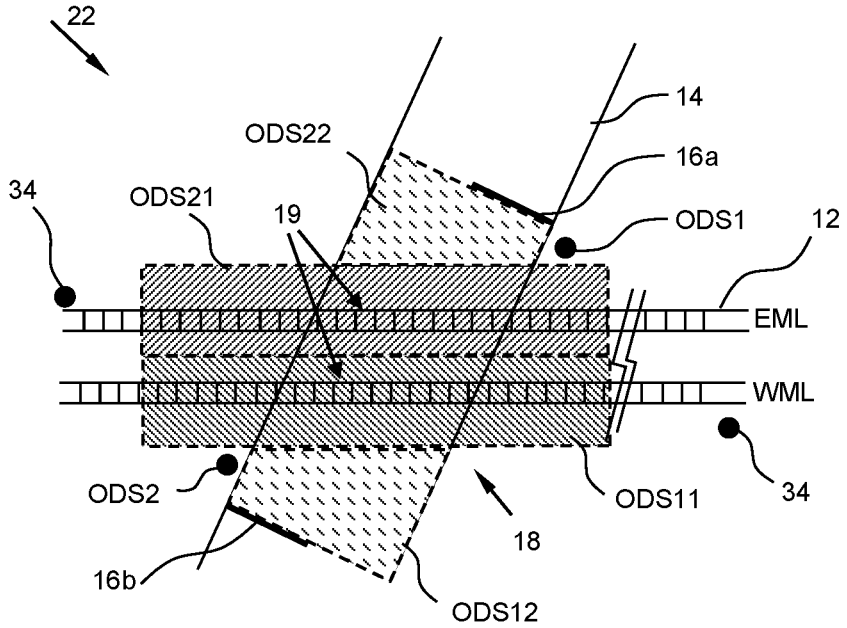

CONTROL ARRANGEMENT FOR A RAILROAD LEVEL CROSSING

CROSS-REFERENCE TO RELATED APPLICATIONS

The present application is a U.S. National Phase filing of International Application No. PCT/AU2016/050533, filed on Jun. 23, 2016, and claiming priority to Australian Patent Application No. 2015902470 filed Jun. 25, 2015. The present application claims priority to and the benefit of all the above-identified applications, which are all incorporated by reference herein in their entireties.

FIELD OF THE INVENTION

The present invention relates to a control arrangement for a railroad level crossing.

BACKGROUND OF THE INVENTION

A railroad level crossing is an intersection between a railroad and a road or path where the railroad traverses the road at the same level, i.e. instead of crossing over it using a bridge or under it using a tunnel.

A problem implicit in level crossings is the increased danger to users of the road due to a collision between a train and a person or vehicle that is traversing the railroad track. As it is not easy to quickly stop a train due to its momentum, the emphasis at level crossings is to clear the track of people and vehicles in advance when a train is approaching so that the train has a clear right of way through the level crossing. This is achieved in most cases by emitting a warning signal when a train approaches the level crossing to instruct users to clear the railroad track and subsequently blocking off the road by boom gates until the train has passed through the level crossing.

The applicant is aware of railroad safety systems to warn a train driver if a railroad track at a level crossing is not free, e.g. if it is occupied by a stalled vehicle or other obstruction. For example, such safety systems are discussed in EP 1849679. If the railroad track is obstructed, then an alarm warning is passed to the train driver to indicate to the driver to slow down or stop the train before it reaches the level crossing. There can also be automatic systems also exist that stop the train if the train driver does not react to the alarm warning.

A disadvantage of existing railroad safety systems is that they are primarily designed for regular passenger or goods trains, which have a much shorter length than heavy haul trains carrying mine ore that may be up to 1.8 km in length. As such the existing safety systems tend to be reactive to the detection of an obstruction at a level crossing and are therefore normally issued only a short period before the train reaches the level crossing. A normal reaction to an alarm warning being raised is thus to stop the train by applying its emergency brakes.

Heavy haul trains used for transporting mine ore normally travel vast distances in very remote areas. Due to increased labour costs and to improve operation efficiency, some of these heavy haul trains have been modified to be autonomous so that they operate without train drivers and are controlled remotely from a central operating office. The autonomous trains are fitted with additional radar and sensory equipment and mapping technology as well as having further trackside sensors installed along the railroad track to govern the movement of the train. In one embodiment utilised by the Applicant, the operation of such autonomous trains is regulated by issuing the train with a Movement Authority to cause the train to autonomously move at an authorised preselected speed to a predetermined location. A number of discrete Movement Authorities may be issued to a train during its transit from its origin to its endpoint destination, whereby each Movement Authority directs the train to move to a desired location.

The generation of each Movement Authority can be a manual process or it can itself be at least partially automated. In either case, a central operating office receives several input variables used to determine the desired Movement Authority. These variables may include, for example, the specific railroad track to use, the number and location of trains running on the track, the overall length of the respective trains, and the speed of travel of the respective trains. Using these variables, the central operating office ensures that the train is able to move without hindrance or possibility of collision with other trains.

As it is desirable to avoid unnecessarily stopping the trains, each Movement Authority is preferably calculated and issued prior to the expiration of an earlier Movement Authority.

SUMMARY OF THE INVENTION

According to one aspect of the present invention, there is provided a control arrangement for a railroad level crossing, the control arrangement comprising:

monitoring sensors for monitoring the level crossing, the monitoring sensors arranged to detect an obstruction within a restricted area at or near to the level crossing;

a processing unit associated with the monitoring sensors and arranged to generate an alarm warning when an obstruction is detected;

wherein the alarm warning is used to adjust a Movement Authority issued to a train approaching the level crossing.

The monitoring sensors may be provided on opposed sides of a railroad track passing through the level crossing.

The monitoring sensors may be provided diagonally across the level crossing.

The monitoring sensors may comprise laser scanner equipment.

The restricted area may comprise a plurality of zones, each zone associated with at least one of the monitoring sensors.

The restricted area may extend outwardly on opposed sides of the level crossing up to boom gates associated with the level crossing.

The monitoring sensors may be adapted to detect an obstruction previously present within the restricted area or an obstruction entering the restricted area.

The processing unit may comprise at least one timer associated with the monitoring sensors to determine a length of time that an obstruction has been detected within the restricted area.

The processing unit may comprise a first timer arranged to be continuously operable irrespective of whether or not a train is approaching the level crossing.

The first timer may be arranged to determine if the obstruction has remained in the restricted area for longer than thirty seconds.

The processing unit may comprise a second timer arranged to be operable only when a train is approaching the level crossing.

The second timer may be arranged to determine if the obstruction has remained in the restricted area for longer than ten seconds.

The processing unit may be operatively associated with an island track of the level crossing, whereby the processing unit may be arranged to determine whether or not an obstruction detected with in the restricted area is another train.

The processing unit may be arranged to prohibit generation of the alarm warning if the obstruction is detected in another train.

The alarm warning may be transmitted to a central operating office for the attention of an operator at the central operating office and wherein the alarm warning may be stored on a vital signalling server.

The alarm warning may be transmitted to a driver of the train.

The train may be an autonomous train with the alarm warning being transmitted to an automated train control system of the train.

BRIEF DESCRIPTION OF THE DRAWINGS

The present invention will now be described, by way of example, with reference to the accompanying schematic drawings, in which:

FIG. 1 is a plan view of a railroad level crossing having a single railroad track traversing a road, wherein the level crossing is provided with a control arrangement according to an embodiment of the present invention;

FIG. 2 is a plan view of a railroad level crossing having a dual railroad track traversing a road, wherein the level crossing is provided with a control arrangement according to an embodiment of the present invention;

DETAILED DESCRIPTION OF THE DRAWINGS

Figure 3:
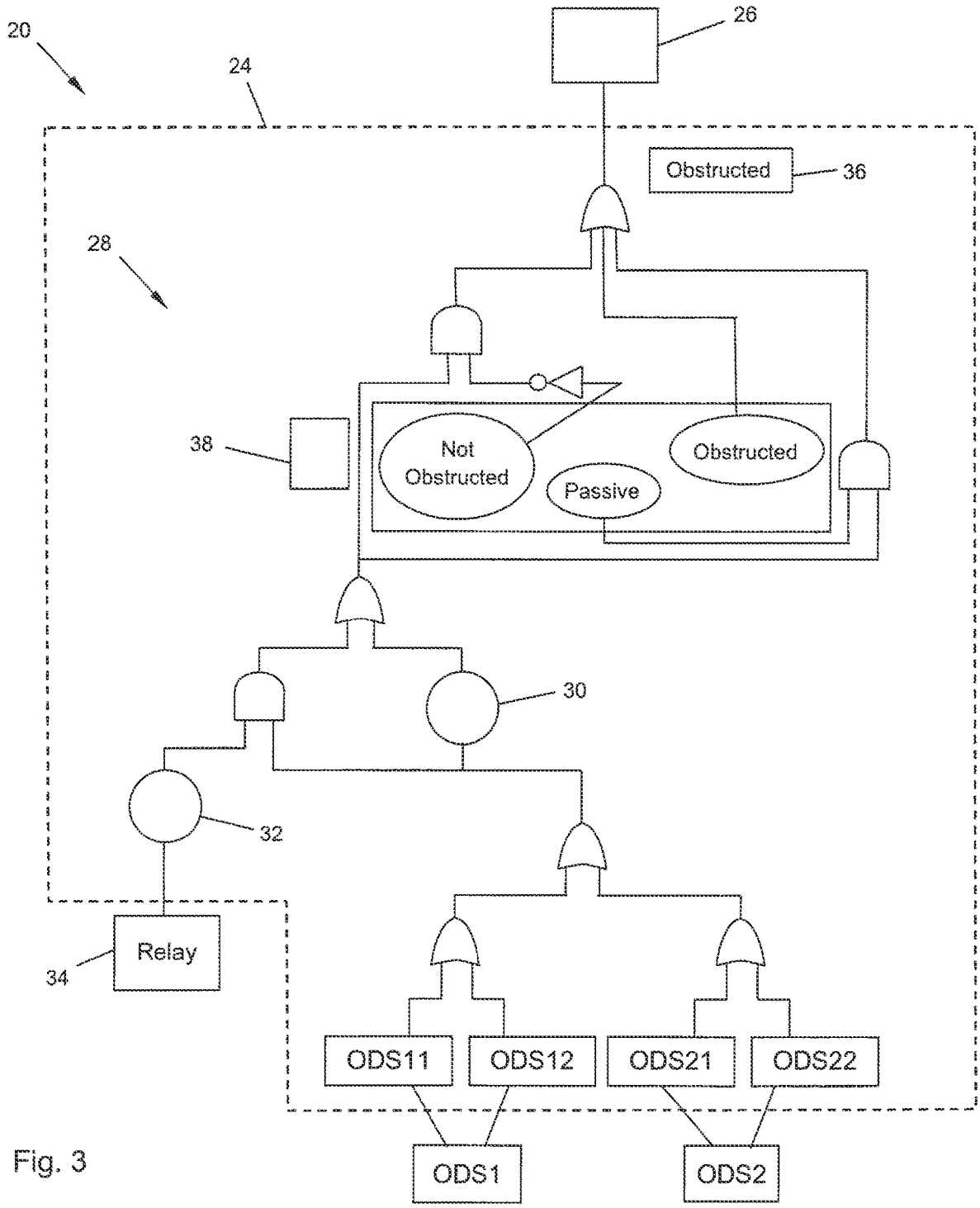
FIG. 3 is a block diagram of the control arrangement of FIGS. 1 and 2 including a logic diagram for the operation of the control arrangement.

Referring to FIG. 1 of the drawings, there is shown a single railroad level crossing 10 showing a single railroad track 12 traversing a road 14. Boom gates 16 are provided on opposed sides of the track 12 and, in use, are adapted to stop people or vehicles traversing a restricted area 18 over and/or near to the level crossing 10 when a train is approaching.

The level crossing 10 further includes a conventional short island track 19 which covers the width of the level crossing 10. This island track 19 is adapted to determine if a train is traversing the level crossing 10 and to raise the boom gates 16 once the train has cleared the level crossing 10.

The level crossing 10 is provided with a control arrangement 20 shown more particularly in FIG. 3.

The control arrangement 20 includes monitoring sensors in the form of laser scanner equipment, wherein two sensors are provided on opposed sides of the track 12 and are arranged diagonally across the level crossing 10. In FIG. 1 the first sensor is indicated as ODS1 and the second sensor is indicated as ODS2. The first sensor ODS1 is arranged to scan area zones of the restricted area 18 indicated by ODS11 and ODS12, where ODS11 is an area zone covering the track 12 near to the sensor ODS1 and where ODS12 is an area zone between the track 12 and its opposed boom gate 16*b*. Similarly, the second sensor ODS2 is adapted to scan area zones of the restricted area 18 indicated by ODS21 and ODS22, where ODS21 is an area zone covering the track 12 near to the sensor ODS2 and where ODS22 is an area zone between the track 12 and its opposed boom gate 16*a*. The monitoring sensors ODS1 and ODS2 are arranged to detect any obstructions present within their respective area zones of the restricted area 18.

As shown in FIG. 2, the control arrangement 20 can be similarly applied to a dual railroad level crossing 22 having a first (or eastbound) railroad track EML and a second (or westbound) railroad track WML traversing a road 14. Due to the similarities between the single and dual railroad level crossings 10 and 22, the same reference numerals are used to indicate like features.

Referring to FIG. 3, the control arrangement 20 includes a processing unit 24 adapted to generate one or more Movement Authorities 26 for a train (referred to hereinafter as the primary train) travelling along the track 12. The processing unit 24 is adapted to receive input from the monitoring sensors ODS1 and ODS2 and to generate a Movement Authority for the primary train. If any obstruction is detected within the restricted area 18 then the processing unit 24 is adapted to adjust a subsequent Movement Authority issued to the primary train.

The processing unit 24 applies a logic process, generally indicated by reference numeral 28, by which the processing unit 24 is able to determine if an obstruction is present at the level crossing 10, 22. The processing unit 24 has a first timer 30 associated with the sensors ODS1 and ODS2. The processing unit 24 further has a second timer 32 associated with the sensors ODS1 and ODS2, the second timer 32 also associated with a track relay 34 that is located along the track 12 in advance of the level crossing 10, 22. The track relay 34 is adapted to be activated (dropped) when a primary train approaches the level crossing 10, 22 and passes beyond the track relay 34.

The level crossing 10, 22 is normally deemed to be in an inactive state when no primary train is approaching the level crossing 10, 22. However, if a primary train approaches the level crossing 10, 22 and passes beyond (drops) the track relay 34 then the level crossing 10, 22 is deemed to be in an active state. The level crossing 10, 22 remains in the active state until the island track 19 indicates that the primary train has passed beyond and cleared the level crossing 10, 22, whereafter the level crossing 10, 22 is again deemed to be in an inactive state.

The first timer 30 is associated with the sensors ODS1 and ODS2 by logic "OR" gates, whereas the second timer 32 is associated with the sensors ODS1 and ODS2 by a logic "AND" gate. The first timer 30 is adapted to be used in conducting a first stage analysis in determining if the level crossing 10, 22 is obstructed. The second timer 32 is adapted to be used in conducting a second stage analysis in determining if the level crossing 10, 22 is obstructed. Both the first stage analysis and the second stage analysis run concurrently. Nominally, in this example, the first timer 30 is programmed to reset at thirty second intervals, while the second timer 32 is programmed to reset at ten second intervals. Accordingly, the first stage analysis is repeated at thirty second intervals, while the second stage analysis is repeated at ten second intervals. However, it should be apparent that both these reset intervals can be adjusted as needed and can be independently configured for shorter or longer periods as desired.

During the first stage analysis, if either monitoring sensor ODS1 or ODS2 detects that an obstruction is present within any one of the area zones ODS11, ODS12, ODS21 or ODS22 of the restricted area 18 and the obstruction remains within the restricted area 18 for a period exceeding the nominal reset interval of the first timer 30 (e.g. thirty seconds) then, applying the steps of the logic process 28, the processing unit 24 will reach a result determination 36 that the track 12, EML or WML is obstructed at the level crossing 10, 22. This first stage analysis is performed continuously both while the level crossing 10, 22 is in its active state and in its inactive state, i.e. irrespective of whether or not a primary train is approaching the level crossing 10, 22.

During the second stage analysis, if a primary train approaches the level crossing 10, 22 and passes the track relay 34, then the second timer 32 will be initiated and the level crossing 10, 22 will be in an active state. If the presence of an obstruction is detected by either monitoring sensor ODS1 or ODS2 within any one of the area zones ODS11, ODS12, ODS21 or ODS22 of the restricted area 18 and the obstruction remains within the restricted area 18 for a period exceeding the nominal reset interval of the second timer 32 (e.g. ten seconds) then, applying the steps of the logic process 28, the processing unit 24 will reach a result determination 36 that the track 12, EML or WML is obstructed at the level crossing 10, 22. This second stage analysis is performed only while the level crossing 10, 22 is in an active state, i.e. only if a primary train is approaching the level crossing 10, 22 and has dropped the track relay 34.

The logic process 28 further makes provision for an override switch 38, which can be toggled to force the processing unit 24 to make an obstructed result determination 36 at the level crossing 10, 22 irrespective of whether or not the presence of an actual obstruction is detected by either of the monitoring sensors ODS1 or ODS2. Such an override switch 38 can be used, for example, if one or more of the sensors ODS1, ODS2 becomes faulty or if the level crossing 10, 22 requires maintenance work and the maintenance workers wish to ensure that no primary train will traverse the level crossing 10, 22.

Figure 4:
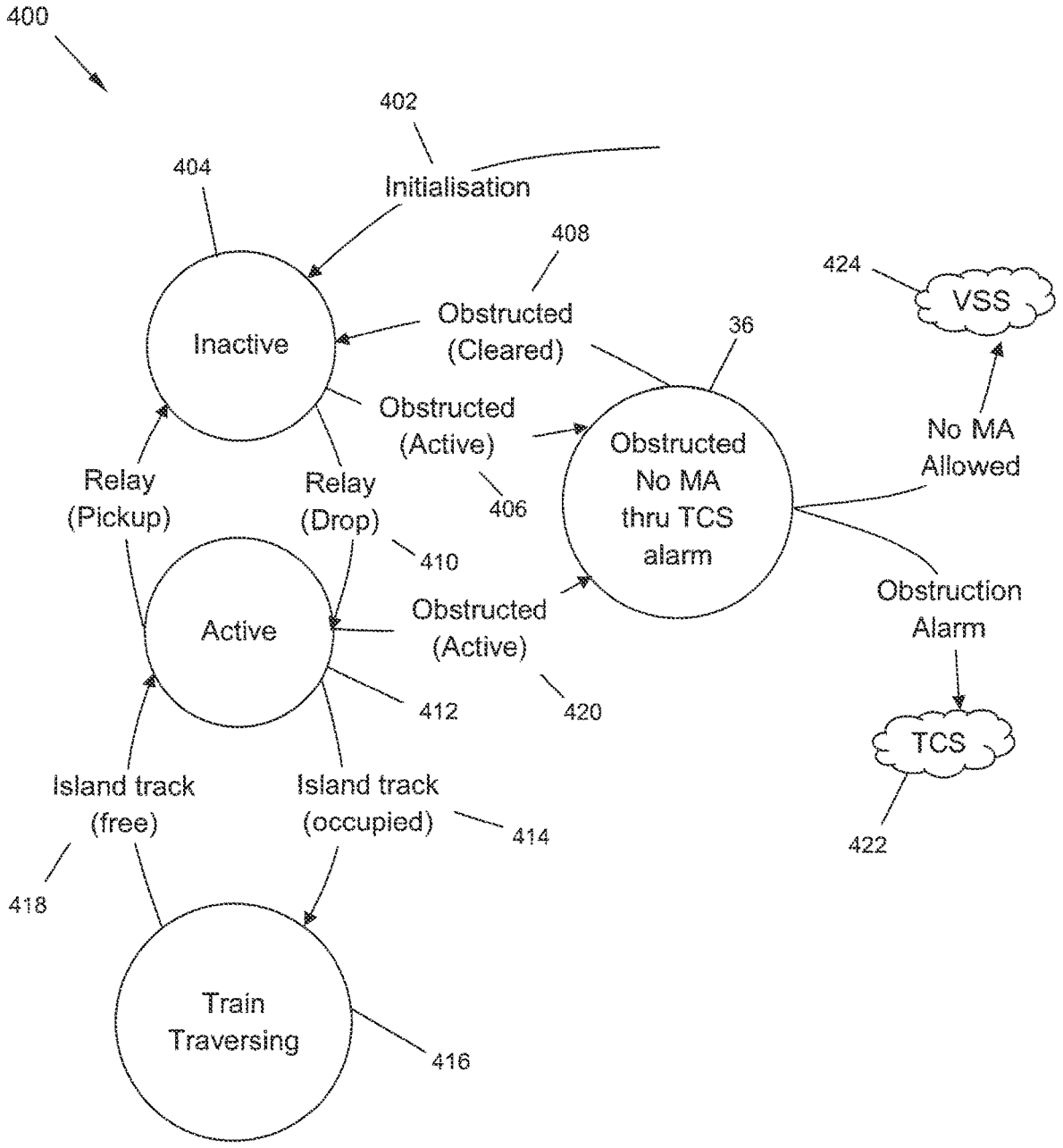
FIG. 4 is an operational flow diagram for the control arrangement used in relation to the level crossing of FIG. 1.

Referring now to FIG. 4, there is shown an operational flow diagram 400 for the control arrangement 20 when used in relation to the level crossing 10 of FIG. 1. After initialisation 402, the level crossing 10 is initially in its inactive state 404.

As explained above, the restricted area 18 is continuously monitored by the monitoring sensors ODS1 or ODS2, even while the level crossing 10 is in the inactive state 404. Thus should an obstruction 406 enter or be present in the restricted area 18 and remain in the restricted area 18 for a period exceeding the (thirty second) nominal period of the first timer 30, then a result determination 36 is made that the level crossing 10 is obstructed. Should the obstruction be cleared 408, then the level crossing 10 returns to its cleared inactive state 404.

In the scenario where a primary train approaches the level crossing 10 and passes the track relay 34 thereby causing a relay drop 410, the level crossing 10 is put into its active state 412 and the restricted area 18 will be monitored for the presence of obstructions by the monitoring sensors ODS1 or ODS2 in relation to the second timer 32. If an apparent obstruction is detected, a further analysis thereof is made to determine if the apparent obstruction is an actual obstruction at the level crossing 10.

It should be borne in mind that two trains can follow each other along the track 12 without forming an obstacle to each other provided they are moving in the same direction and at roughly the same speeds. Accordingly, if the two trains are relatively closely following each other, then a secondary train may still be traversing the level crossing 10 while the primary train is approaching the level crossing 10. Thus the control arrangement 20 determines if the apparent obstruction is merely such a secondary train. This analysis is made by inspecting the island track 19 present in the level crossing 10. If the island track 19 indicates that it is occupied 414, the control arrangement 20 will identify that a secondary train is currently traversing 416 the level crossing 10. Accordingly, the control arrangement 20 will take no further action but merely waits until the island track 19 is cleared 418 after the secondary train has passed out of the restricted area 18 so that the level crossing 10 can return to its active state 412.

However, if the analysis of the island track 19 indicates that it is not occupied, then the control arrangement 20 will identify that the apparent obstruction is an actual obstruction 420 and a result determination 36 is made that the level crossing 10 is obstructed. For clarity, it is emphasised that the control arrangement 20 will reach an obstructed result determination 36 if the presence of any vehicle, any person or any other object is detected within in the restricted area 18 after the track relay 34 is dropped, apart from the presence of a secondary train which will not be considered to be an obstruction. The underlying reasoning therefore is that the location and direction and speed of movement of any secondary train will be known to the central operating office and thus will be taken into account when issuing Movement Authorities to the primary train.

Any result determination 36 reached that the level crossing 10 is obstructed results in the control arrangement 20 raising an alarm that serves to warn operators to prohibit the primary train from moving through the level crossing 10. The alarm warning is transmitted to an automated train control system 422 present on the primary train and the alarm warning is concurrently transmitted to a vital signalling server 424 at the central operating office for reviewing by an operator at the central operating office.

Figure 5:
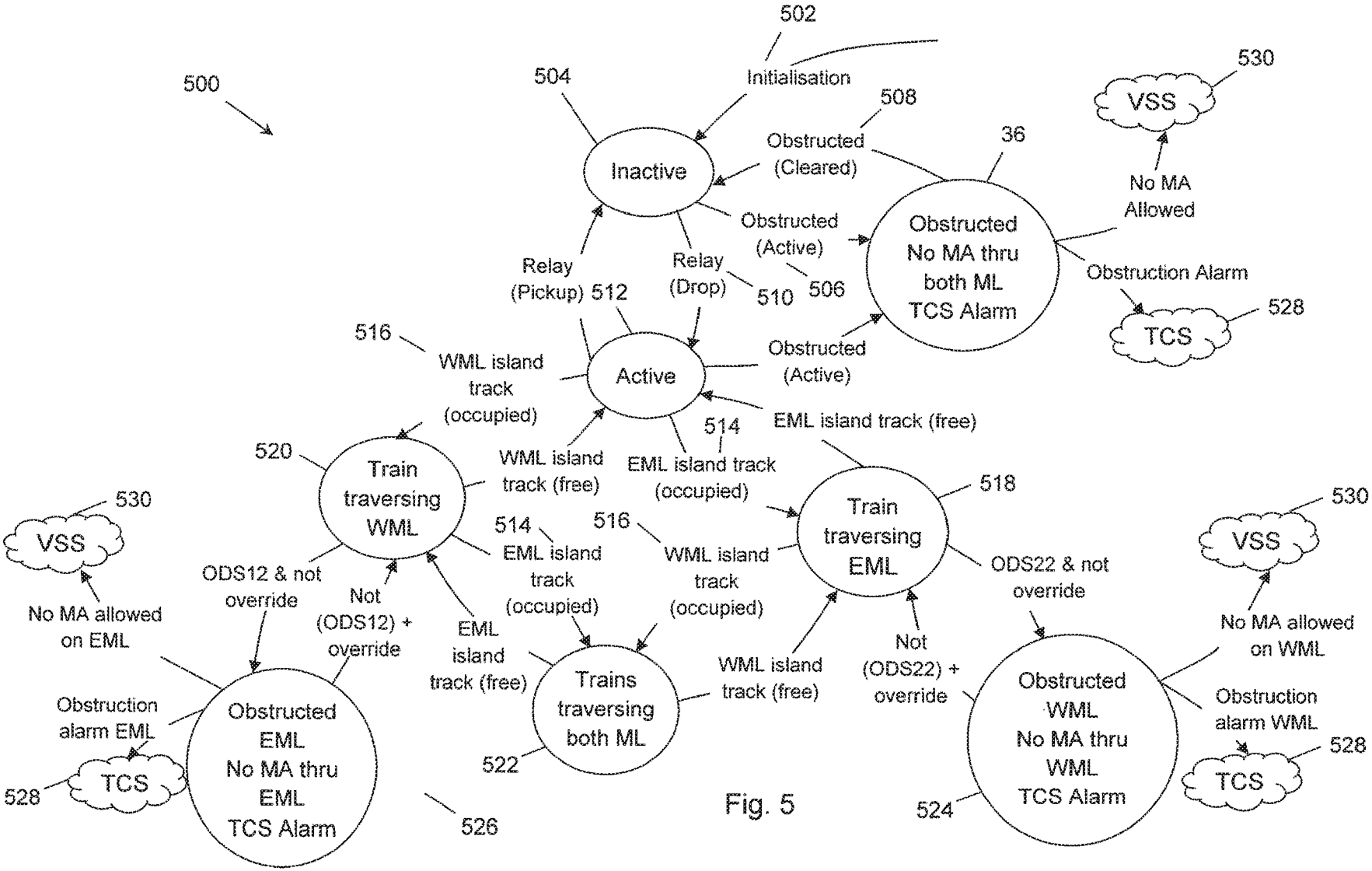
FIG. 5 is an operational flow diagram for the control arrangement used in relation to the level crossing of FIG. 2.

Referring now to FIG. 5, there is shown an operational flow diagram 500 for the control arrangement 20 when used in relation to the level crossing 22 of FIG. 2. After initialisation 502, the level crossing 22 is initially in its inactive state 504.

Similar to above, the restricted area 18 is continuously monitored by the monitoring sensors ODS1 or ODS2, even while the level crossing 22 is in the inactive state 504. Thus should an obstruction 506 enter or be present in the restricted area 18 and remain in the restricted area 18 for a period exceeding the (thirty second) nominal period of the first timer 30, then a result determination 36 is made that the level crossing 22 is obstructed. Should the obstruction be cleared 508, then the level crossing 22 returns to its cleared inactive state 504.

In a scenario wherein a primary train approaches the level crossing 22 and passes the track relay 34 thereby causing a relay drop 510, the level crossing 22 is put into its active state 512 and the restricted area 18 will be monitored for the presence if obstructions by the monitoring sensors ODS1 or ODS2 in relation to the second timer 32. If an apparent obstruction is detected, a further analysis thereof is made to determine if the apparent obstruction is an actual obstruction at the level crossing 22.

Again, it should be borne in mind that two trains can follow each other along either of the a tracks EML or WML without forming an obstacle to each other provided they are moving in the same direction and at roughly the same speeds. If the two trains are relatively closely following each other, then the secondary train may still be traversing the level crossing 22 while the primary train is approaching the level crossing 22. This analysis is made by inspecting the island track 514 on the eastbound track EML and by inspecting the island track 516 on the westbound track WML. If the EML island track indicates that it is occupied 514, the control arrangement 20 will determine that a secondary train is currently traversing 518 the level crossing 22 on the eastbound track EML. Similarly, when the WML island track indicates that it is occupied 516, the control arrangement 20 will determine that a secondary train is currently traversing 520 the level crossing 22 on the westbound track WML. If both the EML and WML island tracks indicate that they are occupied 514, 516, either simultaneously or shortly after each other, then it indicates that secondary trains are traversing the level crossing 22 in both the eastbound and westbound directions 522. Accordingly, the control arrangement 20 will take no further action but merely waits until both the EML and WML island tracks are cleared so that the level crossing 22 can return to its active state 512.

However, if the analysis of the island track in the eastbound track EML indicates that it is not occupied, then it is known that the apparent obstruction detected within the area zones ODS22 and ODS12 is an actual obstruction 524 of the eastbound track EML. Also, if the analysis of the island track in the westbound track WML indicates that it is not occupied, then it is known that the apparent obstruction detected within area zones ODS11 and ODS 21 is an actual obstruction 526 of the westbound track WML. Again, for clarity, it is emphasised that the control arrangement 20 will consider the level crossing 22 obstructed if the presence of any vehicle, any person or any other object is detected within the relevant area zones ODS11, ODS12, ODS21 or ODS22 after the track relay 34 is dropped, apart from the presence of a secondary train which will not be considered to be an obstruction.

Any determination reached that either or both of the tracks EML or WML is obstructed results in the control arrangement 20 raising an alarm that serves to warn an operator to prohibit the primary train from moving through the level crossing 22 on the related EML or WML track. The alarm warning is transmitted to the automated train control system 528 on the primary train and the alarm warning is concurrently transmitted to a vital signalling server 530 at the central operating office.

Any alarm warning 424, 530 transmitted to the central operating office, results in the issuing of a new or an adjustment to the Movement Authority 26 issued to the primary train. Such an adjustment may be to initially slow down the speed of the primary train, and subsequently to limit the Movement Authority to a position located before the level crossing 10, 22 so that the primary train will come to a halt before entering the level crossing 10, 22. If the primary train is already too close to the level crossing 10, 22 to come to a complete halt before traversing the level crossing 10, 22, for example if a person suddenly enters the restricted area 18 after the boom gates 16 have been lowered, then the control arrangement will cause the Movement Authority 26 to be varied such that the emergency breaks of the primary train will be applied thereby to mitigate any damage that may be caused.

Modifications and variations as would be apparent to a skilled addressee are deemed to be within the scope of the present invention.

The invention claimed is:

1. A control arrangement for a railroad level crossing of a heavy haul railway system having one or more heavy haul railway vehicles, the control arrangement comprising:

monitoring sensors for monitoring the level crossing, the monitoring sensors arranged to detect an obstruction within a restricted area at or near to the level crossing; and a processing unit associated with the monitoring sensors and arranged to generate an alarm warning when an obstruction is detected, the alarm warning used to adjust a Movement Authority issued to a train travelling towards the level crossing;

the control arrangement arranged to detect when a train is approaching the level crossing; and the processing unit arranged to concurrently apply a first stage analysis and a second stage analysis, wherein:

in the first stage analysis, an alarm warning is generated if the monitoring sensors detect an obstruction within a restricted area at or near to the level crossing irrespective of whether a train is approaching the level crossing; and in the second stage analysis, an alarm warning is generated if the monitoring sensors detect an obstruction within a restricted area at or near to the level crossing and a train is approaching the level crossing;

wherein the processing unit comprises at least one timer associated with the monitoring sensors to determine a length of time that an obstruction has remained in the restricted area after detection of the obstruction in the restricted area;

wherein in the first stage analysis, the at least one timer is operable to determine whether the obstruction has remained in the restricted area for a first length of time after detection of the obstruction in the restricted area, and the processing unit generates an alarm warning if the first length of time is exceeded;

wherein in the second stage analysis, after detection of the obstruction in the restricted area and a determination that a train is approaching the level crossing, the at least one timer is operable to determine whether the obstruction has remained in the restricted area for a second length of time, and the processing unit generates an alarm warning if the second length of time is exceeded, the second length of time being shorter than the first length of time; and wherein the Movement Authority issued to a train in response to the alarm warning causes the train to slow down or stop depending on the location of the train relative to the level crossing.

2. A control arrangement as claimed in claim 1, wherein the monitoring sensors are provided on opposed sides of a railroad track passing through the level crossing.

3. A control arrangement as claimed in claim 1, wherein the monitoring sensors are provided diagonally across the level crossing.

4. A control arrangement as claimed claim 1, wherein the monitoring sensors comprise laser scanner equipment.

5. A control arrangement as claimed claim 1, wherein the restricted area comprises a plurality of zones, each zone associated with at least one of the monitoring sensors.

6. A control arrangement as claimed claim 1, wherein the restricted area extends outwardly on opposed sides of the level crossing up to boom gates associated with the level crossing.

7. A control arrangement as claimed in claim 1, wherein the monitoring sensors are adapted to detect an obstruction previously present within the restricted area or an obstruction entering the restricted area.

8. A control arrangement as claimed in claim 1, wherein the processing unit is operatively associated with an island track of the level crossing, whereby the processing unit is arranged to determine whether or not an obstruction detected within the restricted area is another train.

9. A control arrangement as claimed in claim 8, wherein the processing unit is arranged to prohibit generation of the alarm warning if the obstruction detected is another train.

10. A control arrangement as claimed in claim 1, wherein the alarm warning is transmitted to a central operating office for the attention of an operator at the central operating office and wherein the alarm warning is stored on a vital signalling server.

11. A control arrangement as claimed in claim 1, wherein the alarm warning is transmitted to a driver of the train.

12. A control arrangement as claimed in claim 1, wherein the train is an autonomous train and the alarm warning is transmitted to an automated train control system of the train.

* * * * *